United States Patent [19]

Park et al.

[11] 4,057,157

[45] Nov. 8, 1977

[54] LOAD COMPACTING AND EJECTING MECHANISM FOR A REFUSE TRUCK

[75] Inventors: Glenn S. Park; William A. Herpich, both of Galion, Ohio

[73] Assignee: Peabody International Corporation, Galion, Ohio

[21] Appl. No.: 730,707

[22] Filed: Oct. 8, 1976

[51] Int. Cl.[2] ..... B65F 3/02

[52] U.S. Cl. ..... 214/302; 100/50; 100/295; 214/82; 214/83.3

[58] Field of Search ..... 100/50, 295; 214/302, 214/303, 83.3, 82

[56] References Cited

U.S. PATENT DOCUMENTS

| | | | |
|---|---|---|---|
| 2,912,128 | 11/1959 | Kamin | 214/82 |
| 3,384,007 | 5/1968 | Boje et al. | 100/98 R |
| 3,621,775 | 11/1971 | Dedio et al. | 100/295 |
| 3,865,260 | 2/1975 | Wieschel et al. | 214/82 |
| 3,988,979 | 11/1976 | Smith | 100/295 |

*Primary Examiner*—Lawrence J. Oresky
*Attorney, Agent, or Firm*—Henry K. Leonard

[57] ABSTRACT

A load compacting and ejecting mechanism for a refuse truck having an open rectangular body and an openable tailgate. An ejector plate extends across the body and is mounted for movement from front to back through the body. The ejector plate has a centrally located compaction plate which is mounted on the ejector plate structure for movement between a front position in which it constitutes a part of the rear face of the ejector plate and a second position rearwardly of the rear face of the ejector plate. A main hydraulic cylinder means extends between and is connected to the front of the body and to the compaction plate. A second hydraulic cylinder means is connected between the main structure of the ejector plate and the compaction plate. A first hydraulic circuit connects the opposite ends of the first cylinder means to a source of hydraulic fluid and includes a control valve for alternatively extending and retracting the main cylinder. A second hydraulic circuit connects the base and rod ends of the second cylinder to each other through a pair of one-way valves which are parallel to each other in the second circuit. The first one-way valve freely allows fluid flow from the base end to the rod end of the second cylinder means. The second one-way valve is connected by an actuating line to the base end of the main cylinder and is pressure responsive for allowing the flow of fluid from the rod end to the base end of the second cylinder means when the resistance to rearward movement of the ejector plate and compaction plate reaches a pre-determined level whereby continued extension of the main cylinder moves the compaction plate rearwardly of the ejector plate.

10 Claims, 5 Drawing Figures

LOAD COMPACTING AND EJECTING MECHANISM FOR A REFUSE TRUCK

BACKGROUND OF THE INVENTION

One of the common types of refuse collecting vehicles comprises an open, elongated rectangular body into which refuse is dumped near its front end, either by operators who actually empty refuse cans through a side door or by powered mechanisms which may raise large refuse containers and dump their contents into such a body. Many of these bodies are equipped with transversely extending ejector plates and have openable tailgates at the rear ends of the bodies. Such an ejector plate usually is actuated by an hydraulic cylinder which first moves the plate and the refuse rearwardly, to compact it against the tailgate, thus to reduce the space occupied, for example, by large cardboard cartons. After the tailgate is opened, the ejector plate is moved all the way to the rear of the body to eject a load of refuse from the body at a location such as a city dump.

When large volumes of refuse are dumped into a truck of this type the ejector plate usually is cycled, first to move the refuse backwardly to compact it somewhat and, when the resistance to further movement of the ejector plate backwards reaches a certain level, the controls are reversed to pull the ejector plate to the front of the body for the reception of additional refuse.

Because the resistance to compaction is a function of the area of the ejector plate acting against the entire mass of refuse in the vehicle body, it is the object of the instant invention to apply the same hydraulic force to a small portion of the ejector plate to extend such a "compaction plate" into the refuse to achieve further compaction.

It is therefore the principal object of the instant invention to provide an ejector plate mechanism which consists of a main, transversely extending ejector plate that is powered by a main hydraulic cylinder which acts between a forward part of the vehicle body and the ejector plate structure to move the ejector plate rearwardly for pushing the refuse to the rear of the truck and partially compacting it against the closed tailgate, the mechanism also including a compaction plate which is extended rearwardly relative to the main ejector plate when the resistance to further rearward movement of the ejector plate reaches a predetermined level.

It is yet another object of the instant invention to provide a transversely extending ejector plate powered by a hydraulic cylinder and including a compaction plate which is generally centrally located in the ejector plate and forms a part of the refuse contacting face of the ejector plate and which is pivotally mounted at its upper end to the ejector plate; the main cylinder being connected directly to the compaction plate and one or more secondary cylinders being connected between the ejector plate structure and the compaction plate; the hydraulic circuitry including a pressure relief valve which controls the flow of fluid to the secondary cylinders so that the compaction plate can be moved rearwardly relative to the main ejector plate when the resistance to the movement of the ejector plate reaches a predetermined level.

Other and more specific objects and advantages will become apparent from the specification which follows and from the drawings to be described below.

DESCRIPTION OF PREFERRED EMBODIMENT

Figure 1:
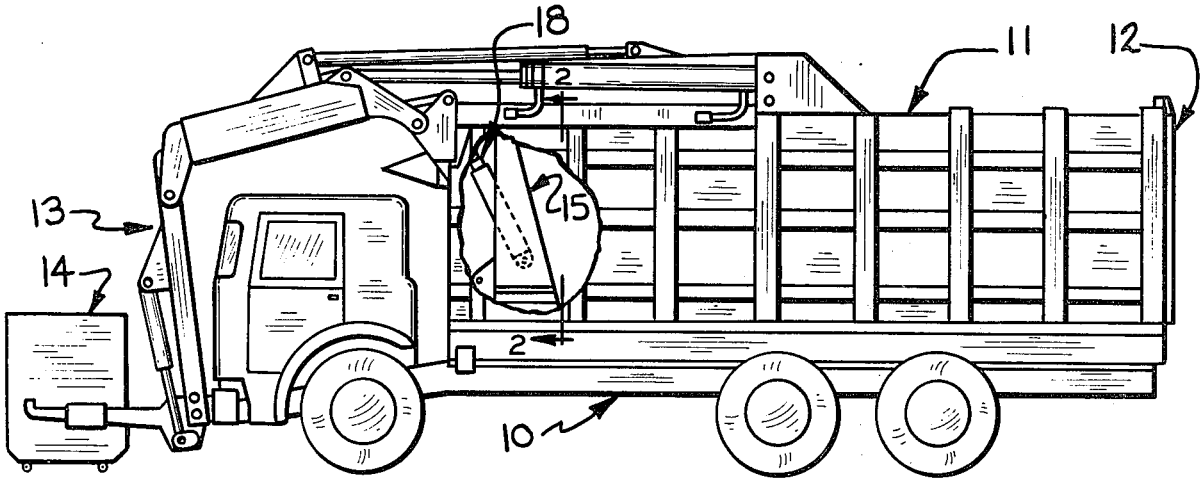
FIG. 1 is a side view in elevation of a front loading type of refuse truck equipped with an ejector plate mechanism embodying the invention, parts being broken away to show parts of the mechanism.

A refuse truck generally indicated with the reference number 10 has an elongated, hollow rectangular body 11, the body being provided with an openable tailgate 12 and being mounted upon the chassis of the truck 10. The truck 10 is illustrated as having a front loading mechanism 13 adapted to engage, to raise, to invert and to dump refuse from large refuse containers 14. When the mechanism 13 is actuated a refuse container 14 is raised over the top of the body 11 and dumped through an opening **11*a* (FIG. 3) in the top of the body 11, located near the front of the body 11**. The particular loading mechanism is well known in the art and does not, in itself, constitute a part of the instant invention.

Figure 2:
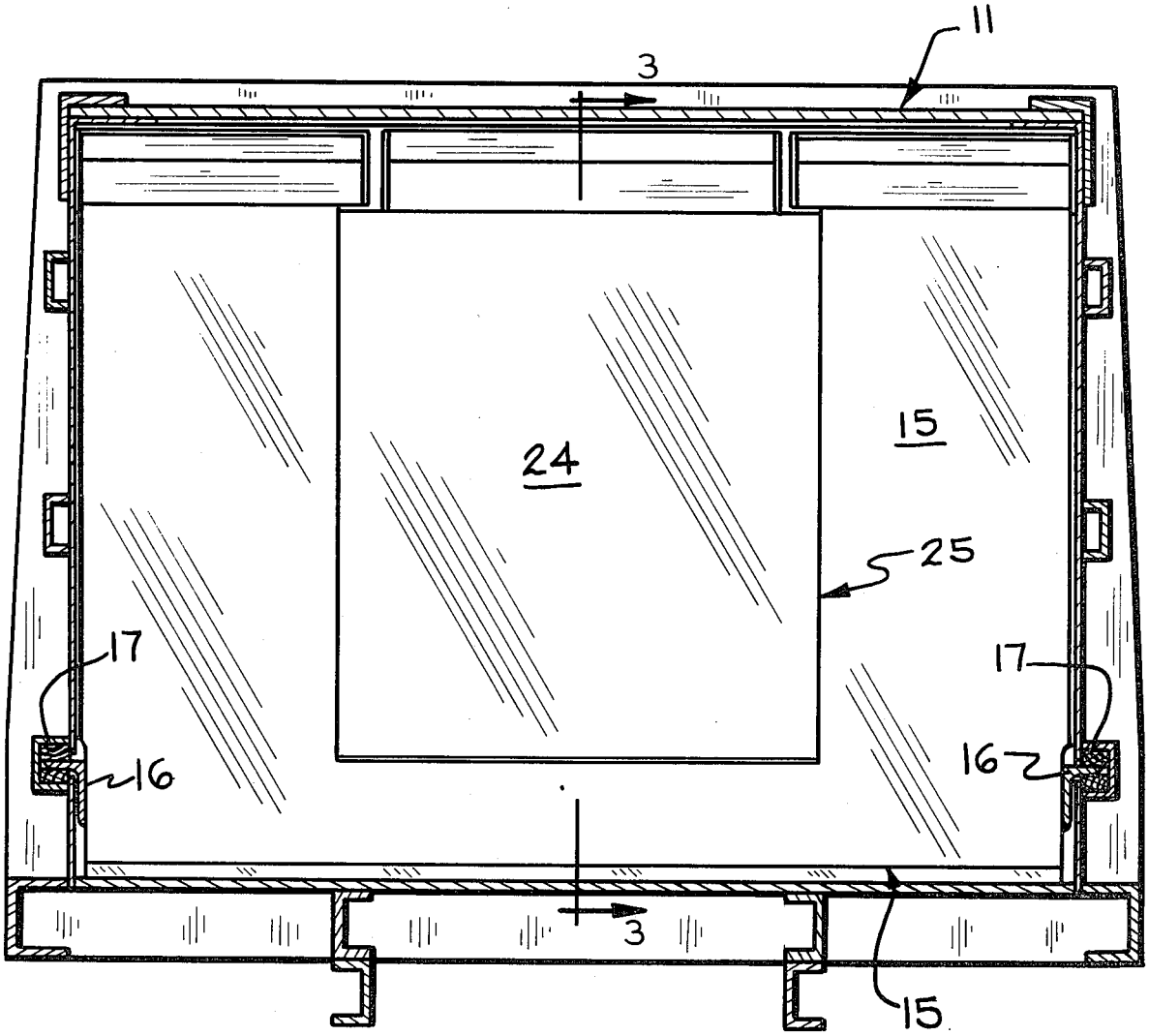
FIG. 2 is a vertical sectional view taken along the line 2—2 of FIG. 1 and shown on an enlarged scale.

A truck of this type is equipped with a main ejector plate 15 which extends transversely across the interior of the body 11 and is guided for movement back and forth in the body 11 by slides 16 (FIG. 2) which travel in ways 17 mounted in the side walls of the body 11. The ejector plate 15 is actuated by a main hydraulic cylinder means 18, in this case a multiple-stage, telescoping cylinder, which is illustrated as being connected between the upper front corner of the body 11 and the structure of the ejector plate 15, but may be connected to the body at a lower level, if desired.

Figure 3:
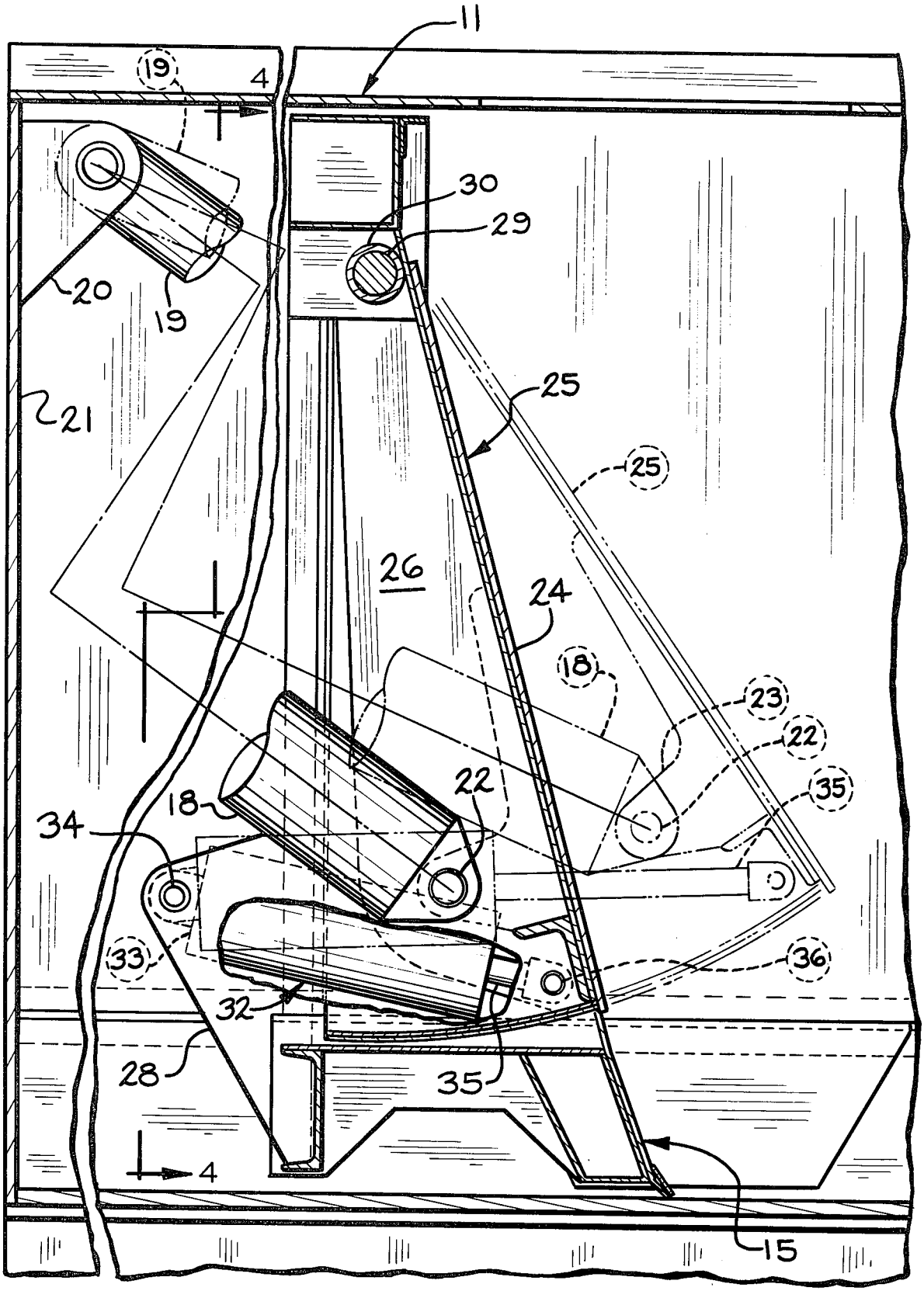
FIG. 3 is a fragmentary, vertical sectional view taken along the line 3—3 of FIG. 2, and shown on a further enlarged scale, illustrating in detail a mechanism embodying the invention.
Figure 4:
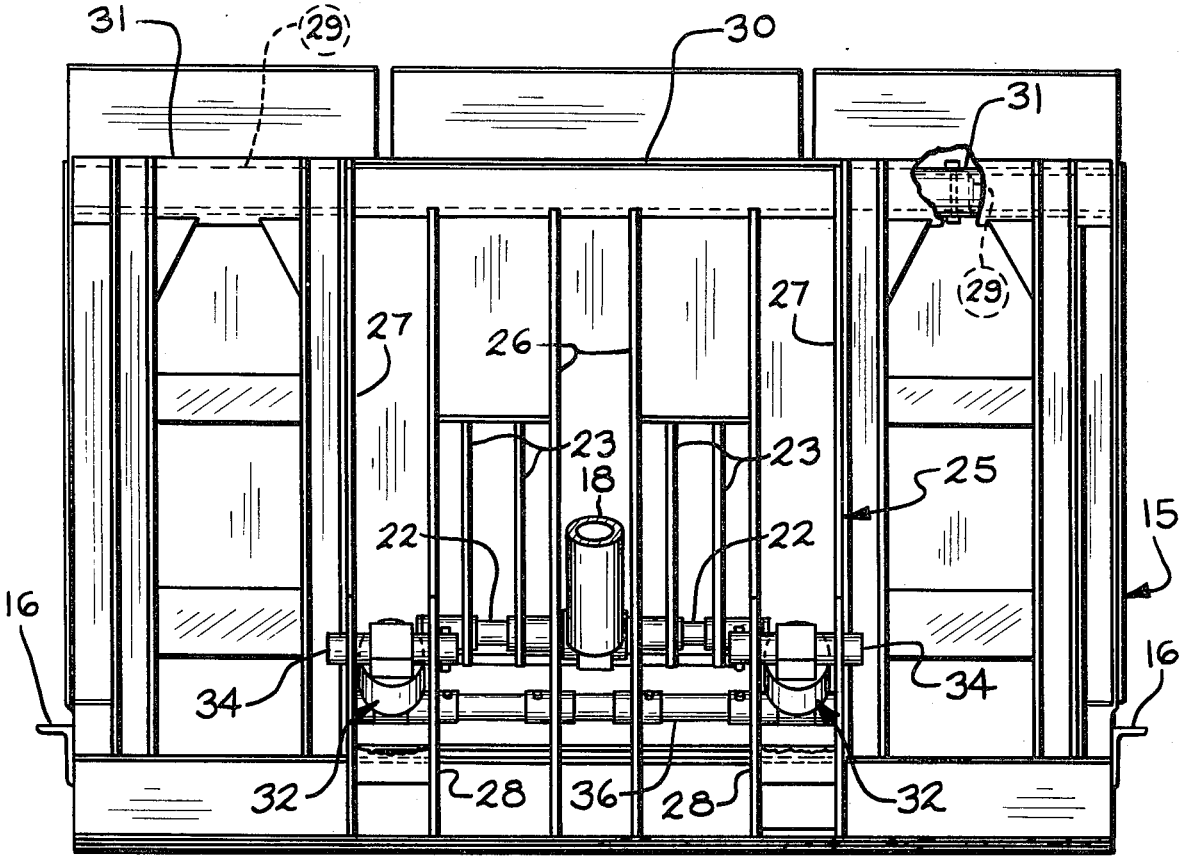
FIG. 4 is a fragmentary, vertical sectional view taken along the line 4—4 of FIG. 3 and shown on the same scale as FIG. 2.

In FIG. 3 the telescoping cylinder means 18 is illustrated as being pivotally connected by its rod 19 to a pair of ears 20 that are mounted on a heavy front wall 21 of the truck body 11. The base, or cylinder end, of the cylinder means 18 is pivotally connected to a cross rod 22 (FIG. 4) which, in turn, extends through a series of vertically extending, parallel heavy gusset plates 23. The gusset plates 23 are welded or otherwise rigidly connected to a rectangular face 24 of a compaction plate 25.

The compaction plate 25 also has vertical reinforcing plates 26, side plates 27 and thrust pin support plates 28, all of the plates 26–28, inclusive, extending vertically and parallel to each other and forming the structure for the support of the face 24 of the compaction plate 25, itself. The entire compaction plate 25 is pivotally mounted in the structure of the ejector plate 15 for angular movement from the position shown in solid lines in FIG. 3 to the rear position shown in broken lines in FIG. 3. The compaction plate 25 is mounted for this pivotal movement on a heavy cross bar 29 which extends through sleeves 30 at the upper edge of the compaction plate 25 and shorter border sleeves 31 mounted in the structure of the ejector plate 15 near its upper end.

Two second hydraulic cylinder means 32 are mounted within the structure of the ejector plate 15, their base ends 33 being pivotally carried by thrust pins 34 which extend through the side plates 27 and the inwardly spaced, parallel support plates 28. Rods 35 of the second cylinder means 32 are yolked to a cross rod 36 which extends horizontally across the compaction plate 25 through the reinforcing plates 26 and the side plates 27.

Figure 5:
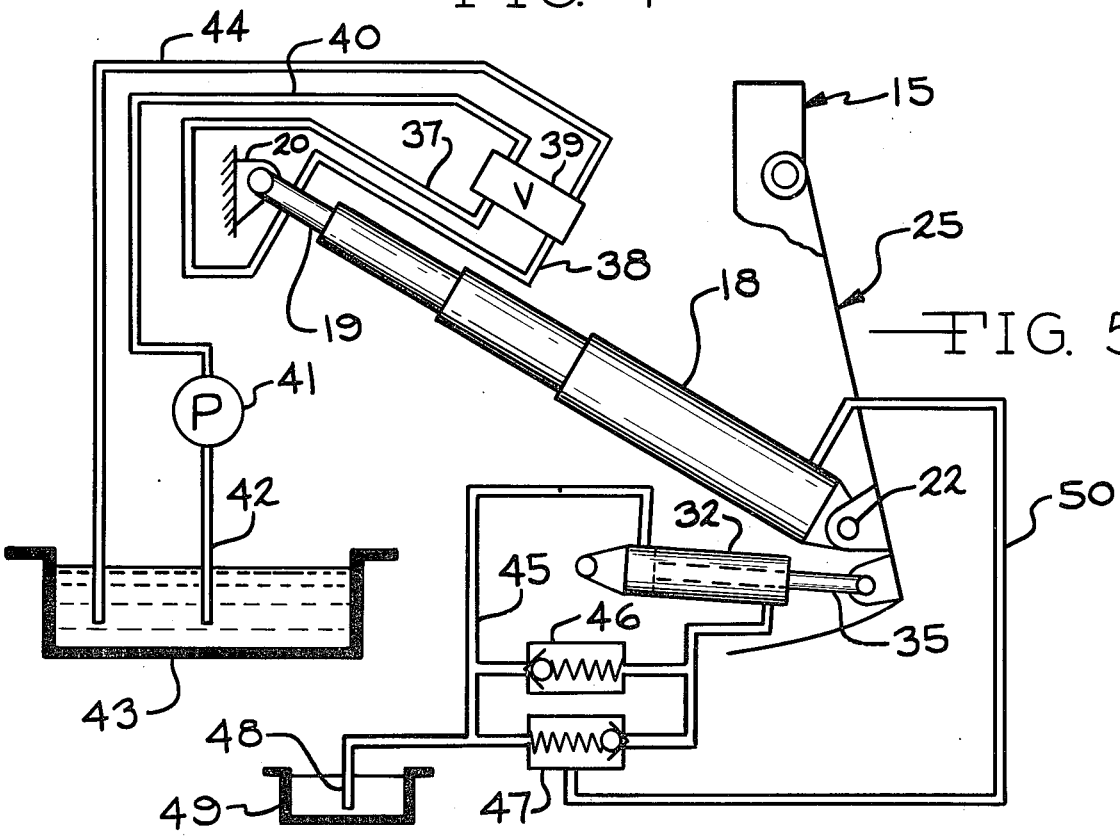
FIG. 5 is a schematic hydraulic circuit illustrating how hydraulic fluid under pressure is made available to actuate a main ejection cylinder means and to provide for the movement of secondary hydraulic cylinder means when desired.

FIG. 5 is a simplified hydraulic circuit showing the main hydraulic cylinder 18 partially extended as if the ejector plate 15 and the compaction plate 25 has been moved rearwardly against a load of refuse in the body 11, compacting that refuse to a degree such that the resistance to further movement of the ejector plate 15 has reached a predetermined level.

The main cylinder 18 is connected by hydraulic lines 37 and 38 to a reversing valve 39. The valve 39, in turn, is connected by a line 40 to a pump 41 and the pump 41 has an intake line 42 from a reservoir of sump 43. The valve 39 is also connected by an overflow line 44 to the sump 43. When the valve 39 is so set as to feed hydraulic fluid from the pump 41 to the base end of the cylinder 18, the cylinder is extended to move the ejector plate 15 and the compaction plate 25 rearwardly in the truck body 11. During this "normal" operation, the rods 35 of the second cylinders 32 are in their retracted positions holding the face of the compaction plate 25 in its normal position as a part of the refuse contacing face of the ejector plate 15.

The base ends of the cylinders 32 are connected by a hydraulic line 45 to the rod ends of the cylinders 32 through a pair of one-way valves 46 and 47 which are located in the line 45, being mounted parallel to each other. The first one-way valve 46 is so designed as to provide for the flow of hydraulic fluid from the base ends of the cylinders 32 to their rod ends with an overflow line 48 branching from the lines 45 and leading to a second sump 49. The second one-way valve 47 is so designed as to prevent the flow of hydraulic fluid from the rod ends of the cylinders 32 to their base ends during "normal" operation, when the main cylinder 18 is extended merely to move refuse from the front of the body 11 toward its rear or, after the body has been completely loaded, and the tailgate 12 has been opened, to move the ejector plate all the way to the rear of the body 11 for ejecting the refuse load therefrom.

However, when a situation is encountered, as is illustrated in FIG. 5, i.e., when the ejector plate 15 has been moved rearwardly against a mass of refuse in the body 11 in order to compact that refuse, and the resistance to further movement of the ejector plate 15 rearwardly against the refuse reaches a predetermined level, pressure in the base end of the cylinder 18 rises by reason of this resistance. When the pressure in the base end of the cylinder 18 reaches a predetermined level, this pressure is transferred by a pressure line 50 that is connected to the pressure responsive valve 47, which causes that valve to open. This provides for flow of hydraulic fluid from the rod ends of the cylinders 32 through the line 45 to their base ends. The main cylinder 18 can then continue to extend, thrusting the compaction plate 25 angularly rearwardly relative to the ejector plate 15 in order to further compact the refuse.

After this extension of the compaction plate 25 has been completed, the operator reverses the valve 39 feeding the hydraulic fluid under pressure to the rod end of the main cylinder 18 to retract that cylinder and, first, to move the compaction plate 25 back into its "normal" position as a continuation of the refuse compacting face of the ejector plate 15. The initial portion of this retraction movement causes fluid to flow from the base ends of the cylinders 32 through the valve 46 to their rod ends, with the excess fluid flowing down the over flow line 48 to the sump 49. Continued retraction of cylinder 18 pulls the ejector plate 15 to the front of the body 11.

Having described our invention, we claim:

1. A load compacting and ejecting mechanism for a refuse truck that has a hollow rectangular body, an openable tailgate at the rear of the body and a refuse receiving opening near the front of the body, said mechanism comprising, in combination:

a. a generally vertical ejector plate which extends across said body and is guided for movement between the front and rear of said body, b. a centrally located compaction plate mounted on said ejector plate for movement between a forward position in which it constitutes a part of the ejector plate surface and a position rearwardly of the surface of said ejector plate, c. main hydraulic cylinder means connected between the front of said body and the structure of said compaction plate for moving said ejector and compaction plates through said body, d. second hydraulic cylinder means connected between the structure of said ejector plate and said compaction plate for controlling the movement of said compaction plate relative to said ejector plate, e. a hydraulic fluid circuit including a source of hydraulic fluid under pressure and a control valve for alternatively connecting said source to the base and rod ends of said main cylinder, f. a second hydraulic fluid circuit connecting the base and rod ends of said second cylinder means through a pair of oppositely effective one-way valves connected in parallel in said second circuit, 1. the first of said one-way valves providing for fluid flow from the base end to the rod end of said second cylinder means, 2. the second of said one-way valves normally being closed for preventing fluid flow from the rod end to the base end of said second cylinder means and including pressure responsive means for the opening thereof, and g. means connecting the pressure responsive means of said second one-way valve to the base end of said main cylinder means, whereby when the resistance to rearward movement of said ejector plate and said compaction plate causes the pressure in the base end of said main cylinder means to reach a predetermined level, said second one-way valve is opened thereby and said main cylinder means moves said compaction plate rearwardly of the surface of said ejector plate, thus the second hydraulic cylinder plus said pair of one-way valves serves as a lock to either lock the movement of said compaction and ejector plates or allow relative movement therebetween.

2. Mechanism according to claim 1 in which the compaction plate is rectangular and is hinged at its upper edge for angular movement relative to the ejector plate.

3. Mechanism according to claim 1 in which the main cylinder has one end pivotally connected at the upper front corner of the body and its rod is connected to the compaction plate.

4. Mechanism according to claim 1 in which the second hydraulic circuit retains the second cylinder means in retracted condition while hydraulic fluid is supplied to said main cylinder means for moving the ejector plate and the compaction plate rearwardly.

5. Mechanism according to claim 1 in which the main cylinder means moves the ejector plate to the front of the body after each rearward movement and the refuse truck body has mechanism for dumping refuse into the truck body near its front but behind said ejector plates when said ejector plate is at the front of said truck body.

6. Mechanism for further densifying refuse that has been initially compacted by a main hydraulically powered cylinder which moves an ejector plate rearwardly for compacting refuse against the closed tailgate of a rectangular refuse truck body, said mechanism comprising, in combination:

a. a compaction plate mounted on and carried with said ejector plate for movement between a retracted position in which it constitutes a part of the refuse contacting face of said ejector plate and an extended position rearwardly of such face, b. a second hydraulic cylinder means mechanically connected between the structure of said ejector plate and said compaction plate, c. means connecting one end of said main hydraulic cylinder to said compaction plate, d. plural valve means providing for flow of hydraulic fluid from the base end of said second hydraulic cylinder means to the rod end thereof, and e. means responsive to a predetermined pressure in the base end of said main cylinder providing for flow of fluid from the rod end of said second hydraulic cylinder means to the base end thereof, whereby the second hydraulic cylinder means and said plural valve means locks said second hydraulic cylinder until said predetermined pressure has been reached and then unlocks said second hydraulic cylinder, and further allows retraction of said second hydraulic cylinder upon retraction of said main cylinder.

7. Mechanism according to claim 6 in which the compaction plate is rectangular and is pivotally connected at its upper edge to the ejector plate for angular movement rearwardly of the ejector plate.

8. Mechanism according to claim 6 in which the main cylinder is connected between a front upper corner of the body of the refuse truck and the compaction plate.

9. Mechanism according to claim 6 in which the main cylinder is a telescoping cylinder which is extensible to a length sufficient to move the ejector plate from the front of the truck body all the way to the rear and the second cylinder means comprises two cylinders connected to the compacting plate on opposite sides of the connection of the main cylinder to the compaction plate.

10. Mechanism according to claim 6 and valve means in a hydraulic line between the base end and the rod end of the second cylinder means providing for transfer of hydraulic fluid from the base end to the rod end when the main cylinder means is actuated for moving the ejector plate and the compaction plate to the front of the truck body.

* * * * *